US011738581B2

(12) United States Patent
de la Hoz Matveeva et al.

(10) Patent No.: US 11,738,581 B2
(45) Date of Patent: Aug. 29, 2023

(54) PRINT HEAD MARKING

(71) Applicant: Hewlett-Packard Development Company, L.P., Spring, TX (US)

(72) Inventors: Bladimir de la Hoz Matveeva, Sant Cugat del Valles (ES); Josep Lluis Molinet Munar, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 87 days.

(21) Appl. No.: 17/417,227

(22) PCT Filed: Jun. 14, 2019

(86) PCT No.: PCT/US2019/037319
§ 371 (c)(1),
(2) Date: Jun. 22, 2021

(87) PCT Pub. No.: WO2020/251591
PCT Pub. Date: Dec. 17, 2020

(65) Prior Publication Data

US 2022/0097431 A1 Mar. 31, 2022

(51) Int. Cl.
*B41J 25/34* (2006.01)
*B41J 2/175* (2006.01)

(52) U.S. Cl.
CPC ..... *B41J 25/34* (2013.01); *B41J 2/1752* (2013.01); *B41J 2/1755* (2013.01); *B41J 2/17553* (2013.01)

(58) Field of Classification Search
CPC .... B41J 2/1752; B41J 2/1755; B41J 2/17553; B41J 25/34
See application file for complete search history.

(56) References Cited

U.S. PATENT DOCUMENTS

| | | | |
|---|---|---|---|
| 6,079,823 A | 6/2000 | Droege | |
| 7,111,924 B2 | 9/2006 | Silverbrook | |
| 8,128,185 B2 | 3/2012 | Loyer et al. | |
| 8,162,456 B2 | 4/2012 | Matsuyama et al. | |
| 2009/0112371 A1 | 4/2009 | Hughes et al. | |
| 2014/0093932 A1 | 4/2014 | Murphy et al. | |
| 2018/0086120 A1* | 3/2018 | Kuronuma | B41J 3/36 |

FOREIGN PATENT DOCUMENTS

| | | |
|---|---|---|
| RU | 2348013 C2 | 2/2009 |
| WO | WO-1996034753 A1 | 11/1996 |

* cited by examiner

*Primary Examiner* — Anh T Vo

(57) ABSTRACT

A print head for printer comprises a marking portion to show a marketing that is indicative of a position of the print head in a print head housing, wherein the print head receives the marking due to physical contact with the print head housing.

20 Claims, 5 Drawing Sheets

PRINT HEAD MARKING

BACKGROUND

Printers, such as ink jet printers, have recently been equipped with universal print heads that do not have a fixed associated color. These print heads may be manufactured and packaged with a neutral fluid and fit into any color slot of the print head carriage. After the virgin print head has been inserted into the print head carriage, the neutral fluid may be flushed and replaced with the printing fluid that corresponds to the respective color slot. At the same time, the print head chip may be written with information pertaining to the color or color slot for which the print head is being used. Only from that point in time onwards, the print head has an associated color.

Universal print heads increase the flexibility and user comfort as well as the manufacturing, shipping and warehousing efficiency. However, problems may occur when, after the initial installation, the user removes all the print heads from the printed carriage, such as for maintenance. At that time, the print heads are no longer universal, but have a dedicated color slot. In order to put them back into the appropriate slot, the user needs to perform trial and error replacement until all the print heads are again in their correct slot. This can be time-consuming and can stress the insertion slots and printer electronics.

DETAILED DESCRIPTION

The disclosure relates to a print head for a printer according to independent claim 1, a print head housing for receiving a plurality of print heads according to independent claim 9, and a method for marking a print head according to independent claim 16. The dependent claims relate to preferred embodiments.

A print head for a printer according to an embodiment may comprise a marking portion that is adapted to show a marking that is indicative of a position of the print head in a print head housing. The print head may be adapted to receive the marking due to physical contact with the print head housing.

The marking may not be pre-fabricated on the print head. In particular, the print head may be a universal print head that may not come with a color designation. Rather, the virgin print head may be inserted into any color slot of the print head housing. The print head may receive the marking due to physical contact with the print head housing only upon inserting the print head in the print head housing. Once the marking has been received on the print head, it may indicate a position of the respective print head in the print head housing, such as a print head slot. Afterwards, the user may conveniently remove the print heads from the print head housing and reassemble them without the risk of confusion or misplacement.

Figure 1:
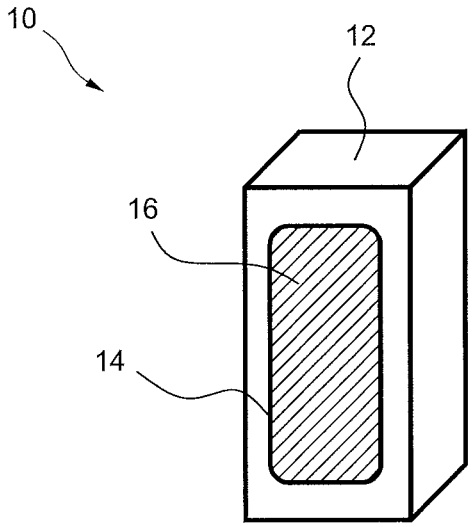
FIG. 1 is a schematic illustration of a print head for a printer according to an embodiment.

FIG. 1 is a schematic illustration of a print head 10 according to an embodiment. The print head 10 comprises a body 12 and may be adapted to be placed in a color slot of a print head housing, such as a print head carriage of an inkjet printer. The print head 10 may have a fluid port for receiving a printing fluid from a fluid reservoir of the printer. The print head 10 may additionally comprise a plurality of printing nozzles that eject the printing fluid onto a printing medium, such as paper or cardboard. The print head 10 may further comprise an electronic interface to exchange electronic signals with a printer control unit via the print head housing. These details are not shown in FIG. 1 in order not to clutter the drawing.

The print head 10 may be a universal print head, which may be manufactured and packaged with a neutral fluid that is flushed and replaced by the printing fluid only after the print head has been inserted into the printer housing. Once the print head is inserted into a slot of the print head housing, it may be detected by the printer control unit via the electronic interface. Printing fluid may then be pumped from the fluid reservoir of the printer to the print head 10 via the respective fluid port, and a memory chip of the print head 10 may be written with information pertaining to the color slot and/or color of the printing fluid that correspond to the position of the print head 10 in the print head carriage.

As can be further taken from FIG. 1, the print head 10 comprises a marking portion 14 that may be formed on a surface side of the body 12, such as on a side surface or on an upper surface of the body 12. The marking portion 14 may be adapted to receive and show a marking 16 that is indicative of a position of the print head 10 in the print head housing. The print head 10 may receive the marking 16 due to physical contact with the print head housing, as will be described in additional detail further below with reference to FIGS. 3 and 4.

In some examples, the marking 16 may comprise a dedicated color, as schematically indicated by the hatching in FIG. 1. The color may be indicative of the position of the print head in the print head housing, which in turn may correspond to a printing color. In other examples, the marking 16 may comprise a shape that is indicative of the position of the print head in the print head housing. Additionally or alternatively, it may be the position of the marking 16 on the print head 10 that indicates a position of the print head in the print head housing.

Figure 2:
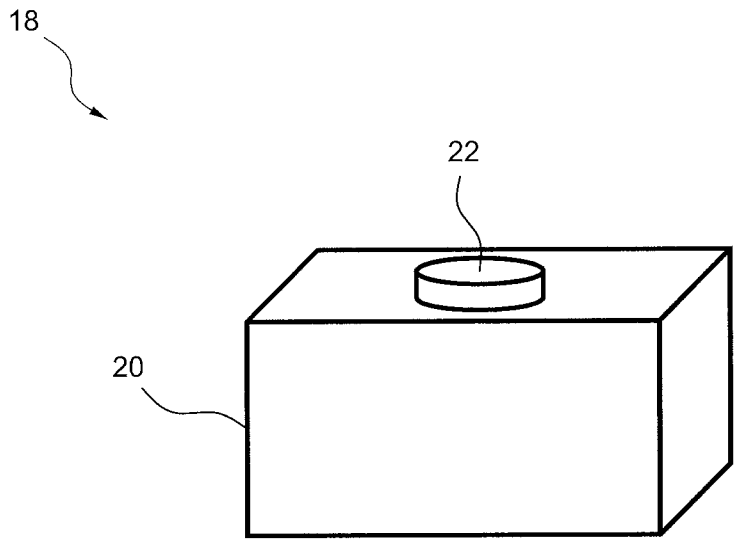
FIG. 2 is a schematic illustration of a print head housing for receiving a plurality of print heads according to an embodiment.

FIG. 2 is a schematic illustration of a print head housing 18 according to an embodiment that may be adapted to receive a plurality of print heads, such as the print head 10 described above with reference to FIG. 1.

The print head housing 18 may comprise a body 20 as well as a marker element 22 that may be adapted to mark at least one print head among the plurality of print heads due to physical contact with the print head, in accordance with the position of the print head in the print head housing 18.

For instance, the marker element 22 may comprise a protrusion or may have the form of a protrusion, wherein the protrusion may be adapted to come into physical contact with the marking portion 14 of the print head 10. Due to the physical contact, the protrusion may mark the marking portion 14 with a marking 16 that indicates the position of the print head 10 in the print head housing 18.

For instance, the print head housing 18 may be a print head carriage of the printer, which may be adapted to receive a plurality of print heads in print head slots that pertain to different colors. The print head carriage may be mounted on the printer to move back and forth across the surface of the printing medium (not shown), wherein the print heads eject printing fluid on the printing medium in accordance with the position of the printing carriage relative to the printing medium.

FIG. 2 shows a print head housing 20 with a single marker element 22. However, this is for illustration only and in some examples the print head housing 20 may comprise a plurality of marker elements. For instance, the print head housing 20 may comprise one marker element for each print head or print head slot that it accommodates.

Figure 3:
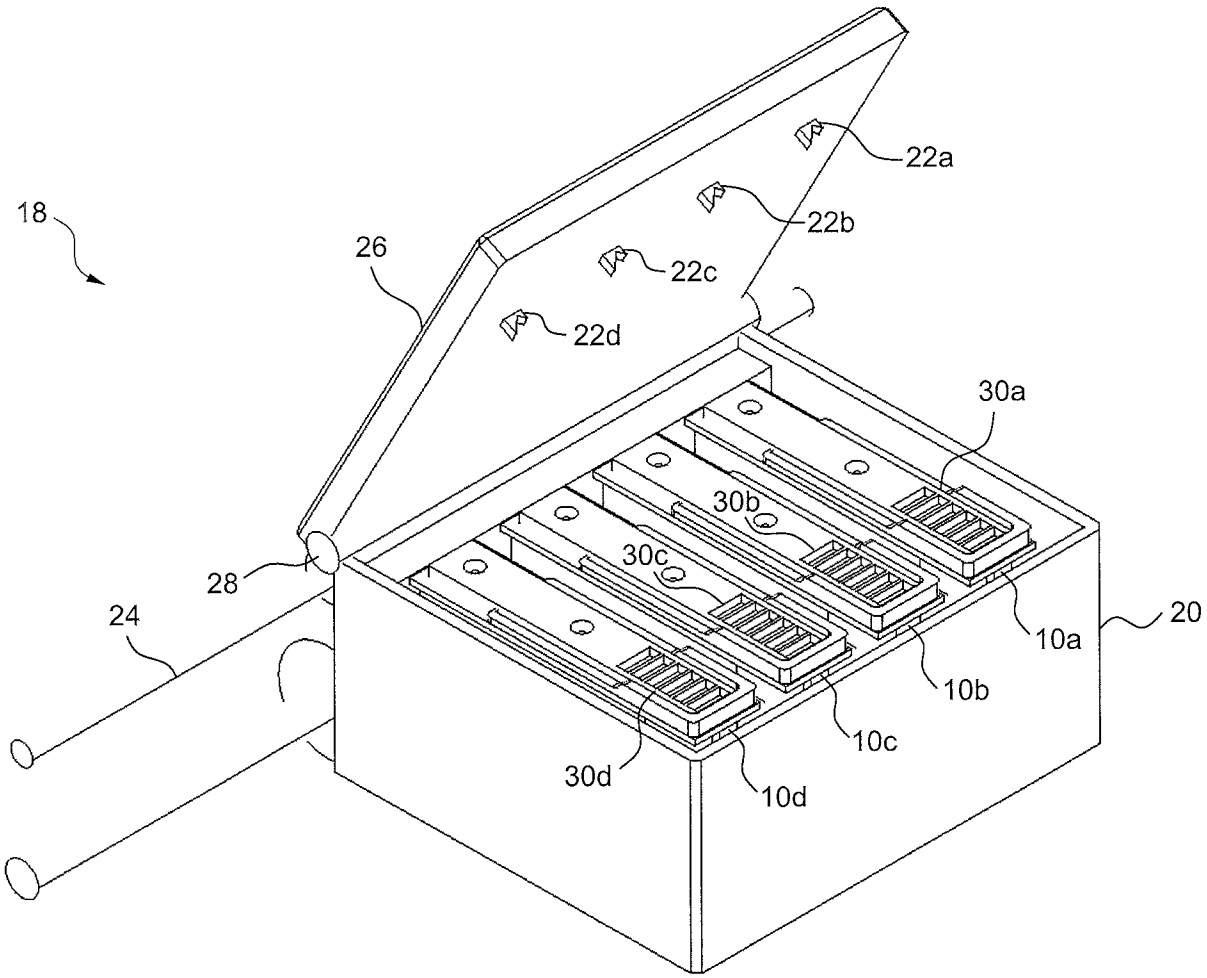
FIG. 3 is a schematic illustration of a plurality of print heads inserted in a print head carriage according to an embodiment.

FIG. 3 is a schematic illustration of a print head carriage 18 that is slidably mounted on a rack 24 of the printer, such as a wide format inkjet printer, so to move across the printing medium (not shown) along the rack 24.

The print head carriage 18 according to the embodiment comprises four print head slots, which may be adapted to receive four print heads 10*a*, 10*b*, 10*c*, 10*d*. Each print head slot may be supplied with printing fluid of a different color.

In other examples, the print head carriage 18 may comprise a different number of print head slots and print heads. For instance, some printers may only have three print heads, while others may comprise five or ten different print heads.

The print head carriage 18 shown in FIG. 3 further comprises a cover element 26, such as a hinged cover, latch or lid that is adapted to close and/or seal the print head carriage 18. When closed, the cover element 26 not only holds the print heads 10*a*-10*d* firmly in their respective positions, but also protects the print heads 10*a*-10*d* against heat or dust.

As can be taken from FIG. 3, an inner surface side of the cover element 16 comprises four protrusions 22*a*-22*d* that serve as marker elements to mark the respective virgin print heads 10*a*-10*d* when the cover element 26 is being closed.

In the embodiment of FIG. 3, the four protrusions 22*a*-22*d* are offset with respect to one another such that a distance of the protrusions 22*a*-22*d* from a hinge axis 28 of the cover element 26 varies depending on the print head slot, i.e., depending on the position of the respective print head 10*a*-10*d* in the print head carriage 18.

As can be further taken from FIG. 3, in this embodiment each of the print heads 10*a*-10*d* comprises a respective marker 30*a*-30*d* on an upper surface side of the print head 10*a*-10*d*, facing the respective protrusions 22*a*-22*d*. The markers 30*a*-30*d* may take the form of recesses marked with different colors, and may comprise a cover sticker that covers the recesses of the virgin print heads 10*a*-10*d*. When the cover element 26 closes the print head carriage 18, the protrusions 22*a*-22*d* punch the cover sticker and thereby reveal the markers 30*a*-30*d* of different colors, in accordance with the position of the respective print heads 10*a*-10*d* in the print head carriage 18.

When the user subsequently opens the cover element 26 again, such as to remove the print heads 10*a*-10*d* for maintenance of the print head carriage 18, each print head 10*a*-10*d* will expose a different color on its top, depending on which of the recesses has been exposed by the protrusions 22*a*-22*d*.

For instance, the exposed color on the print heads 10*a*-10*d* may correspond to the color of the printing fluid for the respective print head slot into which the respective print heads 10*a*-10*d* are placed. The print head slots themselves may also be marked with the respective color. When the print heads 10*a*-10*d* are removed from the print head carriage 18 for maintenance and shall subsequently be placed in the print head carriage 18 again, all the user has to do is to match the color of the marker 30*a*-30*d* on the top of the print head 10*a*-10*d* with the color showing on the print head slot.

Figure 4:
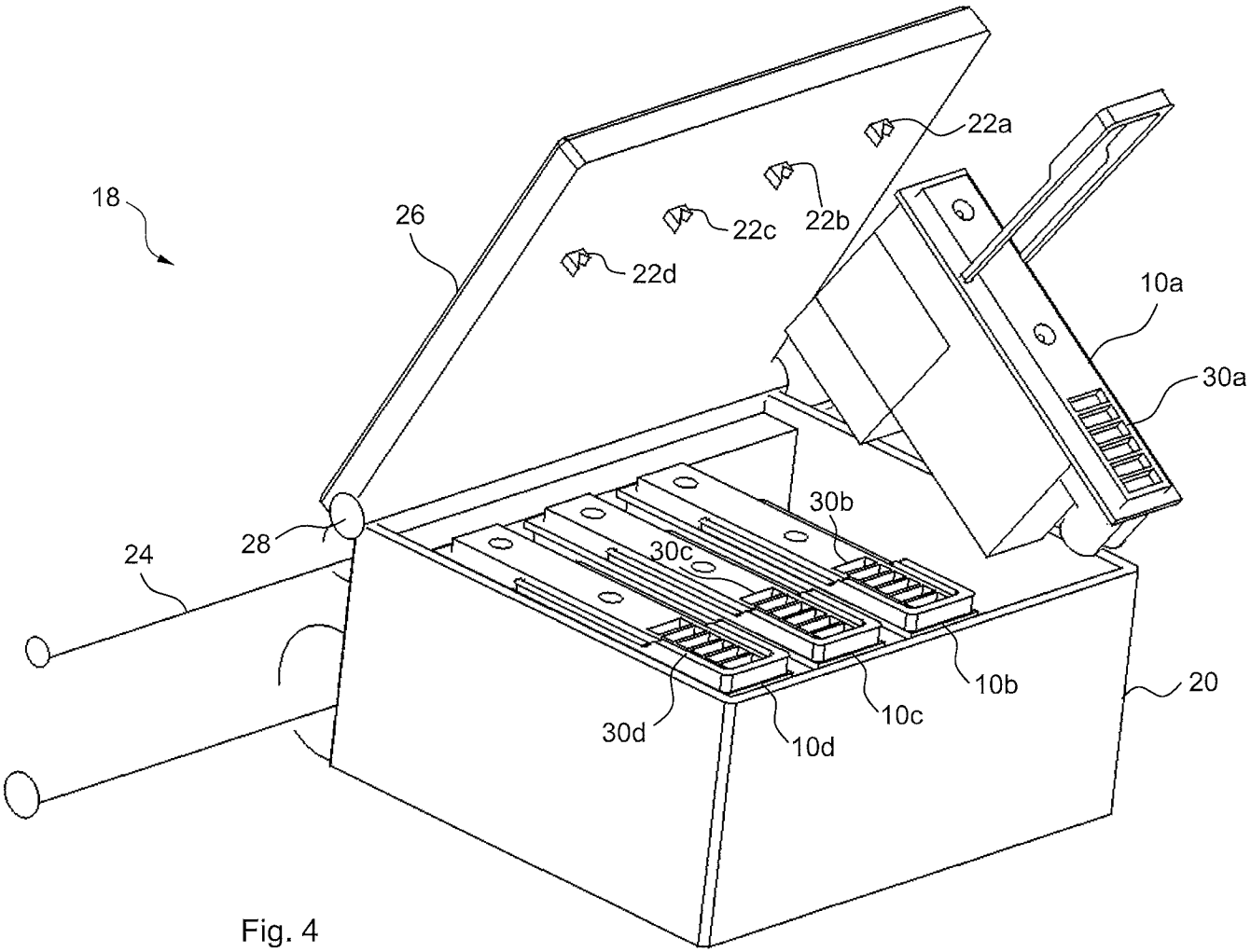
FIG. 4 illustrates the process of inserting a print head in a print head carriage according to an embodiment.

FIG. 4 is a schematic illustration of the print head carriage 18 of FIG. 3, but shows one of the print heads 10*a* being removed from the print head carriage 18. Otherwise, the figure is identical to FIG. 3.

Figure 5:
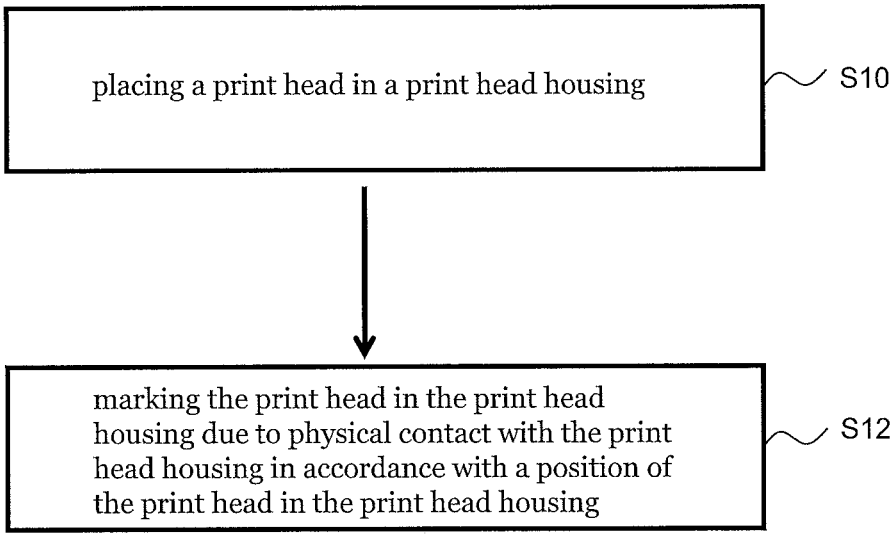
FIG. 5 is a flow diagram illustrating a method for marking a print head according to an embodiment.

FIG. 5 is a flow diagram illustrating a method for marking a print head according to an embodiment.

In a first step S10, a print head is placed in a print head housing, such as the print head carriage 18.

In a second step S12, the print head is marked in the print head housing due to physical contact with the print head housing in accordance with the position of the print head in the print head housing.

In an aspect, the disclosure relates to a print head for a printer, comprising a marking portion to show a marking that is indicative of a position of the print head in a print head housing, wherein the print head receives the marking due to physical contact with the print head housing.

Given that the print head receives a marking that indicates the position of the print head in the print head housing, the print heads can be subsequently associated or linked with their position in the print head housing, in particular with their respective color slot. This can facilitate later reassembly of the print head housing.

The techniques of the disclosure may be employed for a large variety of different printers. A printer, in the context of the present disclosure, may be an ink jet printer, in particular a large format inkjet printer.

According to an example, a position of the marking on the print head depends on a position of the print head in the print head housing. This facilitates the mapping between the position of the print head in the print head housing and the marking.

Alternatively or additionally, a color and/or a shape of the marking on the print head may depend on a position of the print head in the print head housing. For instance, the color of the marking on the print head may correspond to the color of the respective color slot for that print head.

According to an example, the marking portion may be punched by contact with the print head housing.

In some examples, the marking portion may comprise a marker and a cover that covers the marker. The cover may reveal the marker when the cover is punched by contact with the print head housing.

In these examples, it may be the revealed marker that forms the marking.

According to an embodiment, the marking portion comprises a plurality of markers and at least one cover that covers the plurality of markers.

The at least one cover may be punched due to the physical contact with the print head housing at a location corresponding to a position of the print head in the print head housing.

The at least one cover may thereby reveal at least one marker of the plurality of markers in accordance with the position of the print head in the print head housing.

A marking portion, in the context of the present disclosure, may refer to any portion or part on a surface of the print head that is adapted to receive a marking. According to an example, the marking portion may be formed on an upper surface side of the print head.

In another aspect, the disclosure relates to a print head housing for receiving a plurality of print heads, comprising a marker element to mark at least one print head among the plurality of print heads due to physical contact, in accordance with a position of the at least one print head in the print head housing.

A print head housing, in the context of the present disclosure, may refer to any housing adapted to accommodate a plurality of print heads.

According to an example, the print head housing may comprise or may be a print head carriage.

A print head carriage, in the sense of the present disclosure, may refer to a carrier that carries a plurality of print heads and is adapted to be moved across a printing medium. The print heads may eject printing fluid on the printing medium in accordance with a position of the print head carriage relative to the printing medium.

A marker element, in the sense of the present disclosure, may refer to any element adapted to inflict a marking on the print head when brought into physical contact with the print head.

According to an example, the marker element comprises a protrusion to mark the at least one print head, in particular to punch the at least one print head.

According to an embodiment, the marker element comprises a plurality of protrusions to mark the plurality of print heads, in particular to punch the plurality of print heads.

A location of a first protrusion that corresponds to a first print head may differ from a location of a second protrusion that corresponds to a second print head, wherein the second print head may be distinct and/or separated from the first print head.

According to an embodiment, the print head housing may comprise a cover element to cover the at least one print head, wherein the cover element comprises the marker element.

A cover element may be employed in a print head carriage to shield the print heads against the environment and to keep the print heads in place. In the context of the present disclosure, the cover may conveniently double as a marker element when the cover is closed over the print heads.

According to an example, the cover element may be a hinged cover.

According to an example, the marker element contacts and marks the at least one print head when the cover element is closed.

The disclosure further relates to a system comprising a print head with some or all of the features described above and a print head housing with some or all of the features described above, wherein the print head is placed into the print head housing and receives the marking from the print head housing in accordance with a position of the print head in the print head housing.

In another aspect, the disclosure relates to a method for marking a print head, comprising placing a print head in a print head housing, and marking the print head in the print head housing due to physical contact with the print head housing in accordance with a position of the print head in the print head housing.

According to an example, marking the print head comprises punching the print head in accordance with the position of the print head in the print head housing.

According to an example, marking the print head comprises punching the print head at a location on the print head that depends on the position of the print head in the print head housing.

The print head may be punched by means of protrusions formed on the print head housing.

According to an example, the print head may be punched by means of protrusions formed on a cover element of the print head housing, when closing the cover element.

Marking the print head may comprise punching a cover on the print head, wherein the cover covers a marker on the print head.

The above features may be implemented in any combination in embodiments of the disclosure.

The description of the embodiments and the Figures merely serve to illustrate the techniques of the present disclosure, but should not be understood to imply a limitation. The scope of the present disclosure is determined by the appended claims.

The invention claimed is:

1. A print head for a printer, comprising:

a marking portion to show a marking that is indicative of a position of the print head in a print head housing;

wherein the print head receives the marking due to physical contact with the print head housing.

2. The print head according to claim 1, wherein a position of the marking on the print head depends on a position of the print head in the print head housing.

3. The print head according to claim 1, wherein a color and/or a shape of the marking on the print head depends on a position of the print head in the print head housing.

4. The print head according to claim 1, wherein the marking portion is punched by contact with the print head housing.

5. The print head according to claim 1, wherein the marking portion comprises a marker and a cover that covers the marker, and wherein the cover reveals the marker when the cover is punched by contact with the print head housing.

6. The print head according to claim 1, wherein the marking portion comprises a plurality of markers and at least one cover that covers the plurality of markers.

7. The print head according to claim 6, wherein the at least one cover is punched due to the physical contact with the print head housing at a location corresponding to a position of the print head in the print head housing, and the at least one cover thereby reveals at least one marker of the plurality of markers in accordance with the position of the print head in the print head housing.

8. The print head according to claim 1, wherein the marking portion is formed on an upper surface side of the print head.

9. A print head housing for receiving a plurality of print heads, comprising:

a marker element to mark at least one print head among the plurality of print heads due to physical contact, in accordance with a position of the at least one print head in the print head housing.

10. A system comprising a print head according to claim 1 and a print head housing according to claim 9, wherein the print head is placed into the print head housing and receives the marking from the print head housing in accordance with a position of the print head in the print head housing.

11. The print head housing according to claim 10, wherein the marker element comprises a protrusion to punch the at least one print head.

12. The print head housing according to claim 10, wherein the marker element comprises a plurality of protrusions to punch the plurality of print heads, wherein a location of a first protrusion that corresponds to a first print head differs from a location of a second protrusion that corresponds to a second print head.

13. The print head housing according to claim 10, comprising a cover element to cover the at least one print head, wherein the cover element comprises the marker element.

14. The print head housing according to claim 13, wherein the marker element contacts and marks the at least one print head when the cover element is closed.

15. The print head housing according to claim 9, wherein the print head housing comprises a print head carriage.

16. A method for marking a print head, comprising:

placing a print head in a print head housing; and marking the print head in the print head housing due to physical contact with the print head housing in accordance with a position of the print head in the print head housing.

17. The method according to claim 16, wherein marking the print head comprises punching the print head in accordance with the position of the print head in the print head housing.

18. The method according to claim 17, wherein the print head is punched by means of protrusions formed on the print head housing.

19. The method according to claim 18, wherein the print head is punched by means of protrusions formed on a cover element of the print head housing, when closing the cover element.

20. The method according to claim 16, wherein marking the print head comprises punching a cover on the print head, wherein the cover covers a marker on the print head.

* * * * *